US009242701B2

(12) United States Patent
Rasmussen et al.

(10) Patent No.: US 9,242,701 B2
(45) Date of Patent: Jan. 26, 2016

(54) RAIL SYSTEM OF AN OIL SUPPLY SHIP, A METHOD OF POSITIONING AND ARRESTING A HOSE, AND AN OIL SUPPLY SHIP

(71) Applicant: Sp/f 18.10.11, Argir (FO)

(72) Inventors: Jens Meinhard Rasmussen, Argir (FO); Tummas Justinussen, Torshavn (FO)

(73) Assignee: Sp/f 18.10.11, Argir (FO)

( * ) Notice: Subject to any disclaimer, the term of this patent is extended or adjusted under 35 U.S.C. 154(b) by 0 days.

(21) Appl. No.: 14/390,730

(22) PCT Filed: Apr. 11, 2013

(86) PCT No.: PCT/EP2013/057581

§ 371 (c)(1),
(2) Date: Oct. 3, 2014

(87) PCT Pub. No.: WO2013/153154

PCT Pub. Date: Oct. 17, 2013

(65) Prior Publication Data

US 2015/0090176 A1 Apr. 2, 2015

(30) Foreign Application Priority Data

Apr. 13, 2012 (EP) ..... 12164103

(51) Int. Cl.
*B63B 17/04* (2006.01)
*B63B 27/24* (2006.01)
(Continued)

(52) U.S. Cl.
CPC ..... *B63B 17/04* (2013.01); *B63B 25/08* (2013.01); *B63B 27/24* (2013.01); *B63B 27/25* (2013.01); *B63B 27/34* (2013.01)

(58) Field of Classification Search
CPC ..... B63B 27/00; B63B 27/24; B63B 27/18; B63B 22/00; B63B 22/02
USPC ..... 114/218; 141/279, 382, 383, 387, 388
See application file for complete search history.

(56) References Cited

U.S. PATENT DOCUMENTS 2,870,733 A * 1/1959 Winther ..... B63B 21/08 114/218
3,199,650 A * 8/1965 Brown ..... 141/279
(Continued)

FOREIGN PATENT DOCUMENTS

DE 20216616 2/2003
EP 2239190 10/2010
(Continued)

OTHER PUBLICATIONS

International Search Report on corresponding PCT application (PCT/EP2013/057581) from International Searching Authority (EPO) dated May 24, 2013.
(Continued)

*Primary Examiner* — Lars A Olson
(74) *Attorney, Agent, or Firm* — Klein, O'Neill & Singh, LLP

(57) ABSTRACT

A rail system (40, 40') of a ship (30) for positioning and arresting a hose (28) for supplying fluid material to an oil rig (10) from the ship (30) or supplying fluid material to the ship (30) from the oil rig (10). The rail system (40, 40') comprises a rail (44, 44', 46, 46', 47) extending lengthwise at the upper edge of the bulwark of the ship (30). A vertical notch (48, 50) is provided in the rail having a bottom width corresponding to the diameter of the hose (28), and a locking element (52, 52') of an elongated configuration being pivotally journaled adjacent to the vertical notch and being shiftable between a vertical position in which the hose (28) may be freely introduced into and positioned in the vertical notch (48, 50) and a horizontal position in which the locking element is blocking the entry into the notch and rests on the hose (28) for arresting the hose in the notch.

17 Claims, 7 Drawing Sheets

(51) Int. Cl.

| | |
|---|---|
| ***B63B 27/25*** | (2006.01) |
| ***B63B 27/34*** | (2006.01) |
| ***B63B 25/08*** | (2006.01) |

(56) References Cited

U.S. PATENT DOCUMENTS

| | | | | |
|---|---|---|---|---|
| 3,727,650 | A * | 4/1973 | Ingram | B63B 27/18 141/279 |
| 4,867,211 | A | 9/1989 | Dodge et al. | |
| 5,297,499 | A * | 3/1994 | Grange | F16G 11/00 114/218 |
| 7,484,574 | B2 | 2/2009 | Burnett et al. | |
| 7,628,172 | B2 | 12/2009 | Hjeldnes | |

FOREIGN PATENT DOCUMENTS

| | | |
|---|---|---|
| GB | 1581326 | 12/1980 |
| WO | WO2007/029999 | 3/2007 |

OTHER PUBLICATIONS

Written Opinion on corresponding PCT application (PCT/EP2013/057581) from International Searching Authority (EPO) dated May 24, 2013.

Hanes, Jarle Knut; ODIM ABCS Bulk Hose Handling Light but Stressful; North Sea Offshore Cranes & Lifting Conference; May 11, 2007; Stavanger, Norway.

* cited by examiner

RAIL SYSTEM OF AN OIL SUPPLY SHIP, A METHOD OF POSITIONING AND ARRESTING A HOSE, AND AN OIL SUPPLY SHIP

CROSS-REFERENCE TO RELATED APPLICATIONS

This application is the national phase entry, under 35 U.S.C. Section 371(c), of International Application No. PCT/EP2013/05781, filed Apr. 11, 2013, claiming priority from European Application No. 12164103.9, filed Apr. 13, 2012. The disclosures of the International Application and the European Application from which this application claims priority are incorporated herein by reference in their entireties.

FEDERALLY SPONSORED RESEARCH OR DEVELOPMENT

Not Applicable

BACKGROUND

The present invention relates to a rail system of a ship for positioning and arresting a hose for supplying a fluid material to or from the ship relative to an oil rig, a method of supplying the fluid material and a ship including the rail system.

In the offshore industry, supply ships are used for the supply of materials, in particular fluid materials, i.e. liquids and or granulate material, which are flowable to an oil rig which may be a drilling oil rig, i.e. a rig on which drilling operations are performed for the discovery of oil or gas, a supply rig which supplies oil or gas to e.g. a disembarkation rig or to mainland or alternatively a hotel rig, in which personnel such as drilling workers reside. The above listing of rigs is by no means exhaustive and different or alternative kinds of rigs are contemplated to be relevant in relation to the present invention. For the supply of the fluid, i.e. liquid or granulate fluid material to the rig or receiving such materials from the rig, the supply ships are usually used, which supply ships may deliver e.g. fresh water, fuel oil, base oil, drilling water or other fluids or flowable materials needed for the operation of the rig. Alternatively, the supply ship may in accordance with the teachings of the present invention receive fluids, in particular waste material such as waste oil or waste water from the oil rig, or even oil produced by the oil rig.

The transfer of fluid to and from the oil rig to the supply ship is usually carried out by the use of fairly large hoses through which the relevant material is pumped, and for handling the one or more hoses, one or more cranes located on the oil rig and/or on the ship are used for shifting the hose or hoses between the oil rig and the ship and also positioning the hose properly in an operational position allowing the fluid material or the fluid materials to be pumped through the hose. Techniques of handling hoses of this kind have been described in patent publications in among others DE 202 16 616 U1, U.S. Pat. No. 4,867,211, U.S. Pat. No. 7,484,574, U.S. Pat. No. 7,628,172, EP 2 239 190, GB 1 581 326 and WO 2007/029999, and the latter US patent describes a hose connection device. The assignee in the latter US patent has developed a hose handling technique involving highly elaborated hose handling and fixation techniques involving the use of hydraulically operated cylinders for the locking and fixation of the hose relative to the supply ship. The hose handling techniques developed by the above assignee company, i.e. the Norwegian company ODIM ABCS, is described in a paper presented at a North Sea crane conference in 2007.

A further problem in relation to the handling and operation of hoses interconnecting an oil rig and a supply ship relates to a safety consideration, since a wave may cause the supply ship to be shifted relative to the oil rig from its operational position, which may cause excessive loads to the hoses provided the hoses are not allowed to be disconnected from the supply ship and the excessive loading of hoses may even cause a safety to the personnel operating the oil rig and/or the supply ship.

SUMMARY

In view of the above, there is a need for an improvement of the technique of handling, i.e. positioning and fixing the supply hoses interconnecting an oil rig of the above type or any other type or serving any other functional purpose, and the supply ship, in particular the improvements relating to a more easy and safe operation in relation to the fixation of the hose or hoses relative to the supply ship.

A particular feature of the present invention relates to the fact that the rail system, which may be implemented on a ship in accordance with the teachings of the present invention is a self-operating and non-powered system, as will be evident from the below detailed description of the presently preferred embodiment of the rail system and the ship according to the present invention, and allows an easy automated positioning and arresting of the hose relative to the supply ship without the need of use of hydraulic or pneumatic clutches or rocks and without the need of having personnel catching or handling the hose, which may be extremely large and of large weight.

The method constituting a separate aspect of the present invention of handling and positioning a fluid supply relative to a supply ship in an offshore oil or gas installation allows a simple and automated and non-powered handling and fixating without the need of manpower or external power generating equipment for the proper operation. Due to the above advantage in relation to no need of energy or power to be used for the rail system, the maintenance of the rail system consequently is extremely simple and safety or security checks are further easily carried out without the need of highly elaborated test equipment.

The above advantage together with numerous other advantages and features, which will be evident from the below detailed description of a presently preferred embodiment of the present invention, is in accordance with a first aspect of the present invention obtained by a rail system of a ship for positioning and arresting a hose for supplying fluid material to an oil rig from the ship or supplying fluid material to the ship from the oil rig, the rail system comprising a rail extending lengthwise at the upper edge of the bulwark of the ship, a vertical notch being provided in the rail having a bottom width corresponding to the diameter of the hose, and a locking element of an elongated configuration being pivotally journaled adjacent to the vertical notch and being shiftable between a vertical position in which the hose may be freely introduced into and positioned in the vertical notch and a horizontal position in which the locking element is blocking the entry into the notch and rests on the hose for arresting the hose in the notch, the locking element being journalled on a joumaling shaft relative to the rail and preferably defines in the vertical position a lower part below the shaft and an upper part above the shaft, the lower part providing an extension extending in the vertical position of the locking element into the vertical notch for being contacted by the hose for causing the hose pressing onto the extension the locking element to shift from the vertical position to the horizontal position.

According to the teachings of the present invention, the rail system constituting a further aspect of the present invention simply includes a self-positioning locking element due to its elongated configuration and pivotally positioning adjacent a notch of the rail of the rail system and allows the locking element to be simply shifted between the vertical position, in which a hose may be properly positioned in the corresponding notch of the rail of the rail system and the horizontal system, in which the locking element locks the hose in its intentional and arrested position.

In accordance with the teachings of the present invention, the rail system according to the first aspect of the present invention may comprise a plurality of notches and similarly a plurality of locking elements, each implemented in accordance with the above first aspect of the present invention.

In order to allow the positioning of the hose to be carried out simply by the positioning of the hose in the rail system, the rail preferably has a sloping relative to the bulwark of the hull of the supply ship, such as a sloping of an angle between 5° and 15°, e.g. 10° or alternatively defining a curved rail allowing in a highly simple manner the hose to be positioned at an elevated end of the rail, whereupon the hose simply slides along the rail to the notch of the rail and drops into the notch, whereupon the locking element is shifted from the vertical position to the horizontal position, safely locking the hose in position. In this context, it has to be realised that the rail system according to the present invention may alternatively have a level rail and irrespective of whether or not the rail is sloping or level, i.e. horizontal, the rail system may be integrated into the bulwark of the ship or alternatively positioned behind or outside the bulwark of the ship and preferably in a raised position relative to the operation of the rail work, i.e. constituting equipment in relation to an existing supply ship.

In accordance with a particular aspect of the rail system according to the first aspect of the present invention, the locking element is configured for on the one hand locking or arresting the hose in its intentional position when the locking element is in the horizontal position and in addition, preferably configured so as to define a top surface which in the horizontal position of the locking element is flush or level with the rail. By providing the locking element in this particular configuration, the handling of the hose is further improved as in the process of positioning and arresting more than a single hose, the first hose provides after its automated shifting of the locking element from the vertical position to the horizontal position, a top surface which is level and flush with the rail system and consequently, simply allows a further hose to be shifted past the position, in which the first hose is received for positioning the second or further hose. The provision of the top surface of the locking element being flush with the rail provided the locking element is in the horizontal position provided the rail is as described above, sloping slightly relative to horizontal as in the sloping configuration of the rail system according to the first aspect of the present invention in combination with the configuration of the locking element having a top surface level or flush with the rail in the horizontal position of the locking element, the positioning and arresting of several hoses is as be described in greater details below simply accomplished by positioning the first hose in an elevated part of the sloping rail sliding the hose into the first notch which causes the locking element to shift to a horizontal position, whereupon the next or second hose is simply sliding past the first position, in which the first hose is located and received in a adjacent or neighbouring notch, which is then closed off by the shifting of the locking element from the vertical position to the horizontal position and in doing so, allowing a still further or third hose to be easily shifted to a third position by sliding under the impact of the gravitational force the hose down the rail of the rail system.

In relation to the safety precaution of allowing a disconnection of the hose from the supply ship in case an emergency situation occurs, such as a situation in which a wave shifts the ship relative to the oil rig, the two parts of the locking element are preferably hinged to one another allowing the one part, preferably the top part, to be shifted sidewise relative to the bulwark of the ship and in doing so, allowing the hose to slide in the notch in which the hose is received without causing any substantive damage to the hose, in particular a rupture or partial deterioration of the hose.

The hinged connection between the upper and lower part of the locking element of the rail system according to the first aspect of the present invention may be implemented by having the two parts connected through a return element such as a spring or spring steel or rubber element, which returns the shiftable part to its initial position in the elongated configuration of the locking element for re-establishing the safe and secure arresting of the hose within the notch in its intentional position.

The above advantages together with numerous other advantages and features, which will be evident from the below description of the present invention is in accordance with a second aspect of the present invention obtained by a method of positioning and arresting a hose for supplying fluid material to an oil rig from a ship or supplying fluid material to the ship from the oil rig, comprising providing a rail system comprising a rail extending lengthwise at the upper edge at the bulwark of the ship, providing a vertical notch in the rail having a bottom width corresponding to the diameter of the hose and providing a locking element being of an elongated configuration and being pivotally journalled adjacent to the vertical notch and being shiftable between a vertical position and a horizontal position, the method comprising introducing the hose into the notch while maintaining the locking element in the vertical position and for shifting the locking element to the horizontal position and blocking the entry into the notch and arresting the hose in the notch.

The above advantages together with numerous other advantages and features, which will be evident from the below description of the present invention is in accordance with a third aspect of the present invention obtained by a ship or vessel for supplying fluid material to an oil rig or for receiving fluid material from the oil rig, the ship comprising a rail system including a rail extending lengthwise at the upper edge of the bulwark of the ship, a vertical notch being provided in the rail having a bottom width corresponding to the diameter of the hose, and a locking element of an elongated configuration being pivotally journaled adjacent to the vertical notch and being shiftable between a vertical position in which the hose may be freely introduced into and positioned in the vertical notch and a horizontal position in which the locking element is blocking the entry into the notch and rests on the hose for arresting the hose in the notch.

The method according to the second aspect of the present invention and similarly the ship according to the third aspect of the present invention may advantageously and preferably comprise any of the features defined and described above in relation to the rail system according to the first aspect of the present invention.

BRIEF DESCRIPTION OF THE DRAWINGS

The present invention is now to be further described with reference to the drawings, in which.

DETAILED DESCRIPTION

Figure 1:
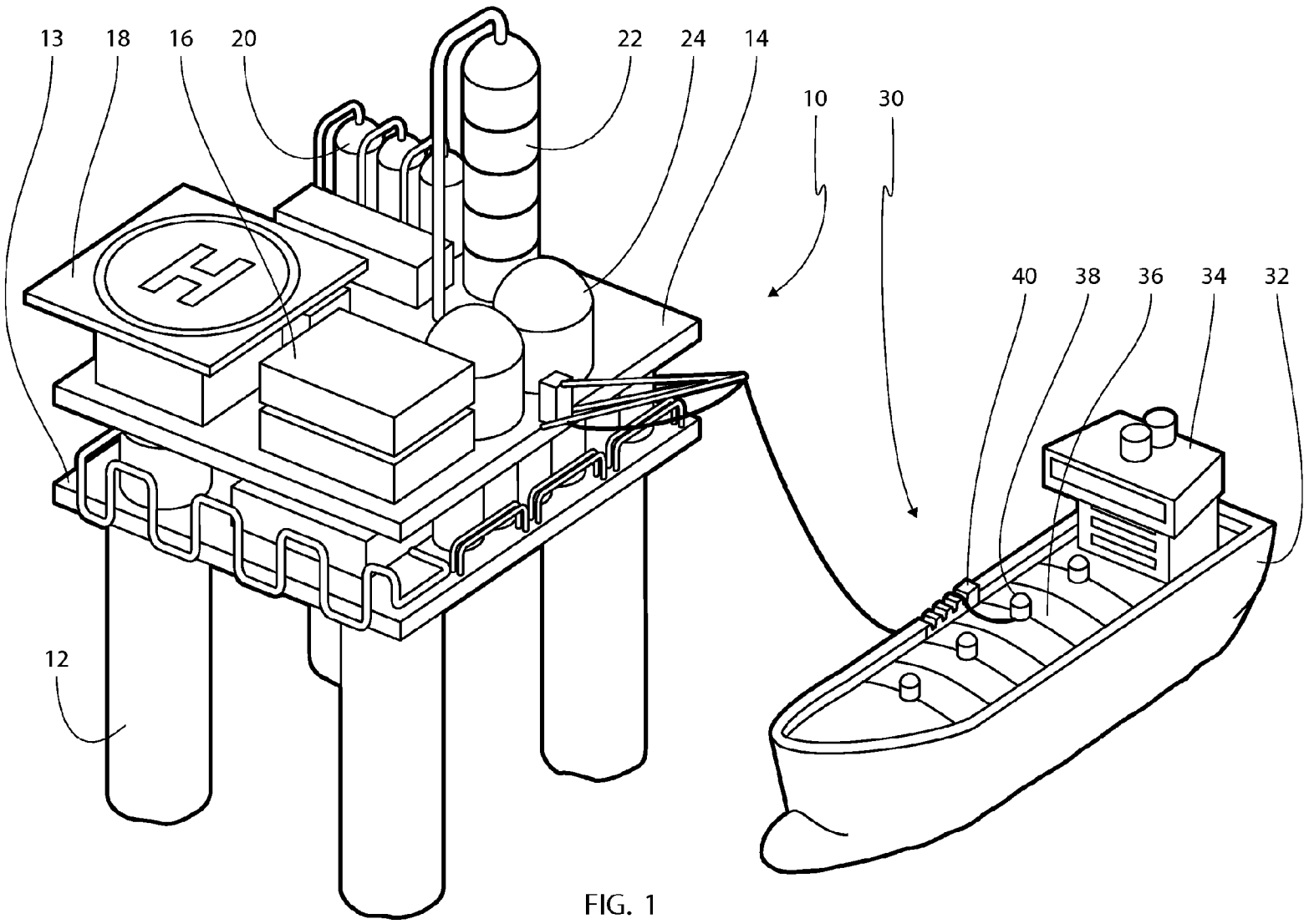
FIG. 1 is an overall perspective and schematic view of an oil rig and a supply ship or vessel, which receives oil from the oil rig or in the alternative, supplies fluid material to the rig through a hose connecting the rig to the ship or vessel.

In FIG. 1, an oil supply rig is shown designated the reference numeral 10 in its entirety. The oil supply rig 10 is positioned on four legs extending to the bottom of the sea and one of which is designated the reference numeral 12. On top of the legs of the oil supply rig, a floor structure is positioned comprising a lower floor 13 and an upper floor 14, on top of which components or elements of the oil supply rig are mounted including a housing 16, a helicopter landing platform 18 and various containers, tanks or reservoirs 20, 22 and 24. No detailed description is presented of the above listed components or elements of the oil supply rig 10, since the oil supply rig as such does not constitute part of the present invention and the above description of the oil supply rig is therefore merely presented in order to provide an overall description and illustration of the oil supply rig.

It is to be understood that the present invention to be further described below may be used in combination with or in connection with alternative structures such as a gas supply rig, an oil drilling rig or alternative off shore structures, which are to be supplied with fluid material from a supply ship or vessel or delivers material such as oil from the rig to a ship or vessel.

In the right-hand part of FIG. 1, a ship or vessel is shown designated the reference numeral 30. The ship or vessel comprises a hull 32, on which a navigation bridge and engine room super structure 34 is positioned and which encloses a plurality of compartmentalised tanks or containers, one of which is designated the reference numeral 36. The tanks or containers may serve to receive oil from the drilling rig or may include fluid materials to be supplied to the oil supply rig 10, such as fuel oil, base oil, fresh water, drilling water or any other fluid used in the oil drilling industry or oil the supply industry. For connecting the tank or container 36 to the oil rig 10, an inlet/outlet 38 is provided to which a hose 38 is connected, which hose extends through the rail system 40 according to the present invention. The rail system 40 serves to position and arrest the hose 28 and possibly additional hoses, which interconnect the ship or vessel 30 with the oil supply rig 10.

Like the oil supply rig 10, the ship or vessel 30 shown in FIG. 1 is only described and illustrated by way of example as the ship or vessel as such may be implemented in accordance with different embodiments, as among others the navigation bridge and engine room super structure 34, which is shown at the stern of the ship or vessel, may alternatively be located at the stem of the ship or vessel. Furthermore, the ship or vessel 30 may like the oil supply rig 10 be provided with a crane, not shown in the drawings.

Figure 2:
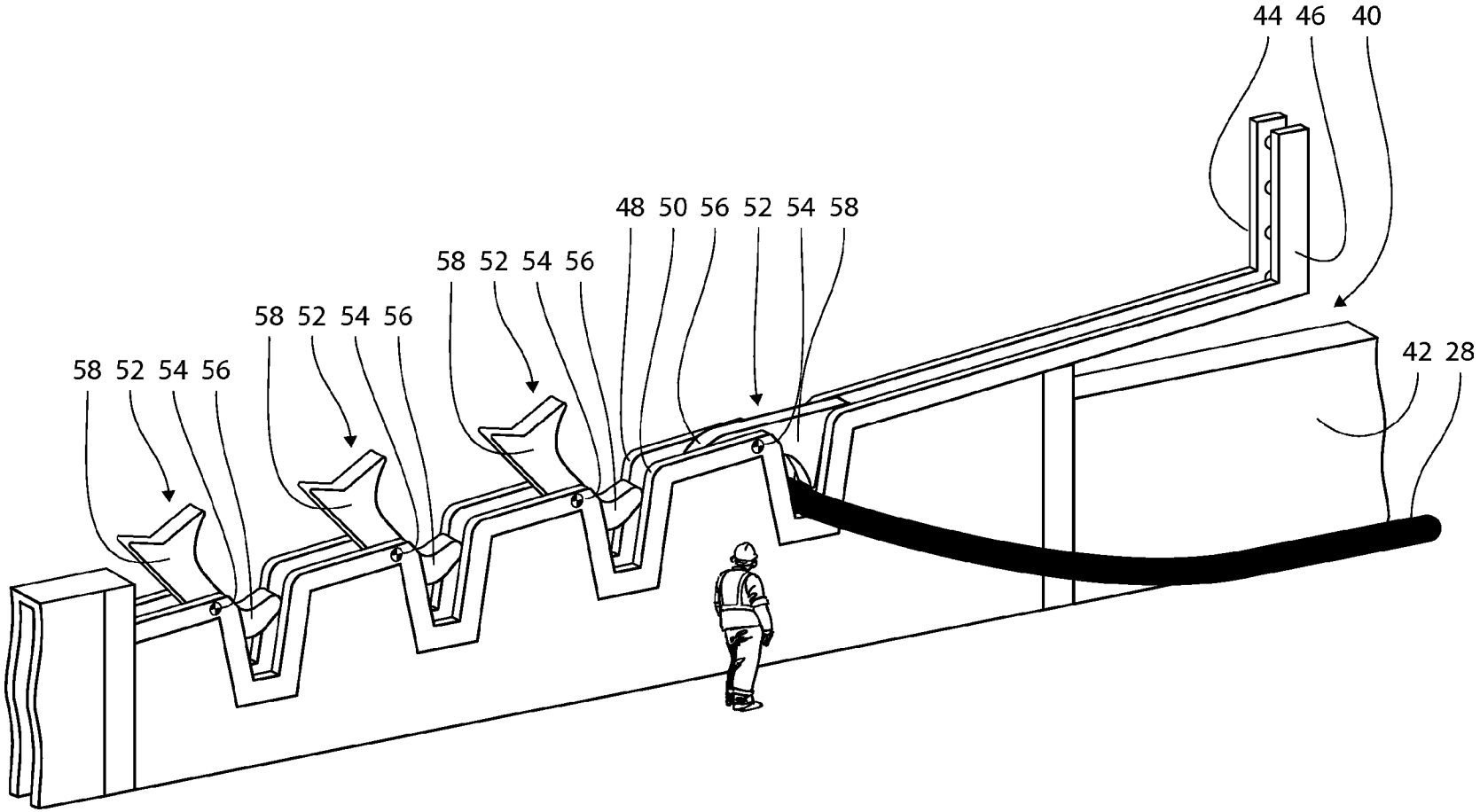
FIG. 2 is a perspective and schematic view of a presently preferred embodiment of a rail system according to the present invention for the positioning and arresting of a hose connecting the oil rig shown in FIG. 1 with the ship or vessel, also shown in FIG. 1, FIGS. 3A-3D are schematic views illustrating the technique of positioning and arresting hoses relative to the rail system shown in FIG. 2, FIGS. 4A and 4B are details of alternative embodiments of the rail system according to the present system.

In FIG. 2, the rail system 40 according to the present invention is shown in greater detail. The rail system 40 constitutes a segment of the bulwark of the ship or vessel, e.g. the ship or vessel 30 shown in FIG. 1. The rail system 40 generally provides in the embodiment shown in FIG. 2 a slightly sloping structure although the rail system according to the present invention may alternatively be implemented without providing the sloping structure, as the rail system is simply integrated in level with the rail of the bulwark of the ship or vessel. In FIG. 2, the reference numeral 42 designates the bulwark and the rail system 40 is shown comprising two generally L-shaped rails or slides designated the reference numeral 44 and 46. In the L-shaped rails or slides 44 and 46, a total of 4 generally V-shaped notches 48 and 50, respectively, are provided. The notches serve, as is illustrated in FIG. 2 to receive the hose 28 and for arresting the hose in its intentional position located in the right-hand or first notch of the notches of the rail system provided by generally V-shaped notches 48 and 50 of the rail and slides 44 and 46, respectively, a tiltable locking element 52 is provided. In FIG. 2, a total of four locking elements are provided, one for each of the four sets of notches 48, 50 and apart from locking the hose in its intentional position as shown in FIG. 2, the locking elements further provide a top surface, which is level with the top surfaces of the rails or slides 44 and 46 and thereby providing a continuation of the generally sloping orientation of the rails or slides 44 and 46. Each of the locking elements 52 comprises a U-shaped lower part 56 and an L-shaped upper part 58 and is journalled on a journaling shaft 54.

In FIGS. 3A-3D, the method of positioning the hose 22 and arresting the hose relative to the rail system 40 is shown in greater detail, illustrating the automatic positioning of the hose in its intentional position relative to the rail system and the provision of an automatic guidance of a further hose to a free position for arresting the further hose in said free position by a further locking element of the rail system.

Figure 3A:
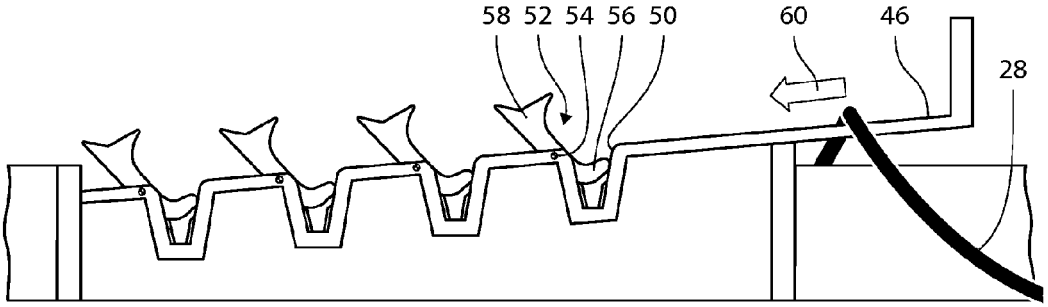
Figure 3B:
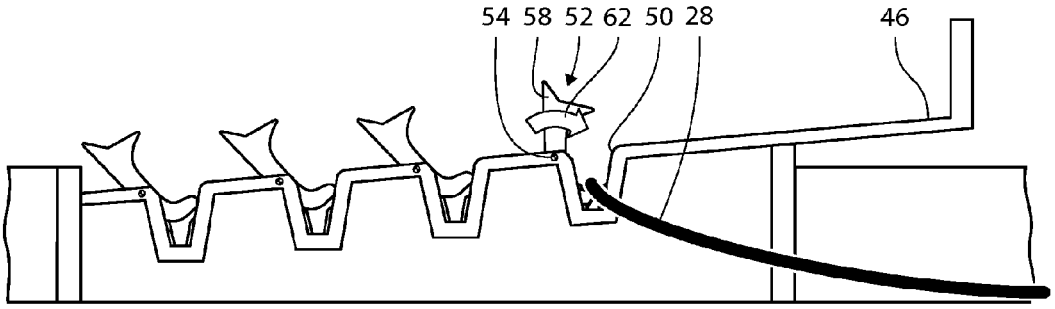

In FIG. 3A, the hose 28 is positioned at the upper most end of the rail or slide 46 as the oppositely positioned rail of the slide 44 is not visible in FIGS. 3A-3D. The hose 28 starts sliding downwards along the rails or slides as indicated by a first arrow 60 due to the gravitational force acting on the hose and as shown in FIG. 3B, the hose reaches the generally V-shaped first notch 50 of the rail or slide 46 and drops into the notch and in doing so, contacts the U-shaped lower part 56 of the locking element 52, which is caused to turn round the journaling shaft 54 as is indicated by a second arrow 62.

Figure 3C:
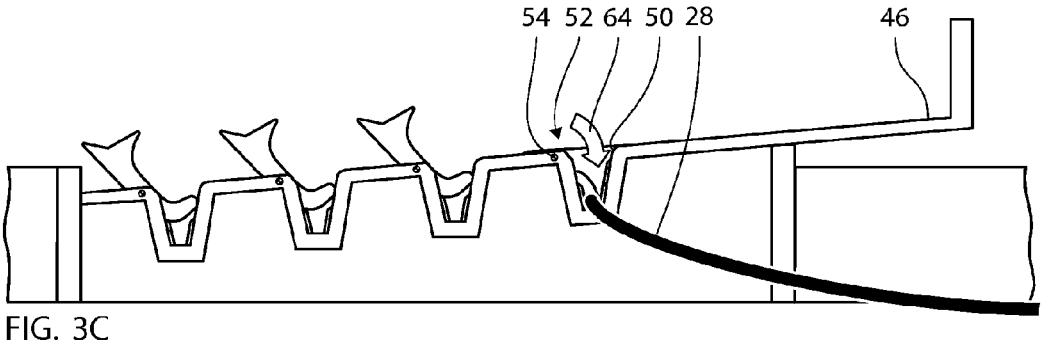

In FIG. 3C, the hose 28 has reached its down-most position in the generally V-shaped notches of the rails or slides and in this position indicated by a third arrow 64, the hose 28 rests freely in the generally V-shaped notches of the rails or slides disconnected from the U-shaped lower part 56 of the locking element 52, which has shifted to a position in which the L-shaped upper part 58 of the locking element 52 is contacting the hose 28 and locks or arrests the hose 28 in its position resting in the notches of the rails or slides. The final turning of the locking element 52 is in FIG. 3C indicated by a third arrow 64 and in the position of the locking element shown in FIG. 3C, the locking element provides as already described above with reference to FIG. 2, a top surface which is level with the top surfaces of the rails or slides 44 and 46.

Figure 3D:
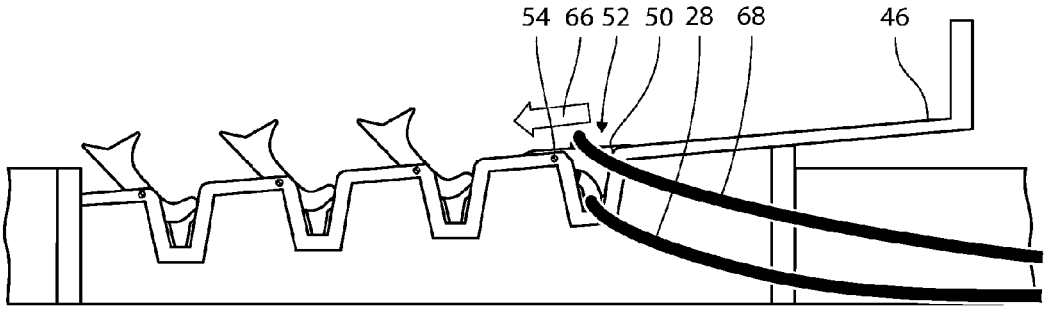

In FIG. 3D, the presence of the top surface provided by the locking element 52 level with the rails or guides 44 and 46 is shown providing a sliding surface allowing a further or second hose 68 to slide as indicated by an arrow 66 past the position occupied by the hose 28 allowing the hose 68 to reach a second position at the left hand side of the position of the hose 28 and allowing the locking element in the second position to turn or swing as is described above with reference to FIGS. 3A-3C in relation to the first locking element for positioning the hose 68 in the second position.

In an alternative embodiment of the rail system, the generally L-shaped rails or slides 44 and 46 are modified into rails or slides level with the rail of the ship or vessel bulwark and in this alternative embodiment, the automatic positioning from the right-hand side of the rail system to the left-hand side end of the rail system as illustrated in FIGS. 3A-3D is not implemented, still, the provision of the locking elements, which due to the larger mass of the L-shaped upper part relative to the lower mass of the U-shaped lower part 56 still provides the automatic turning when contacted by a hose and the automatic locking of the hose in position and the presentation of a top surface level with the rail or slides 44 and 46.

Figure 4A:
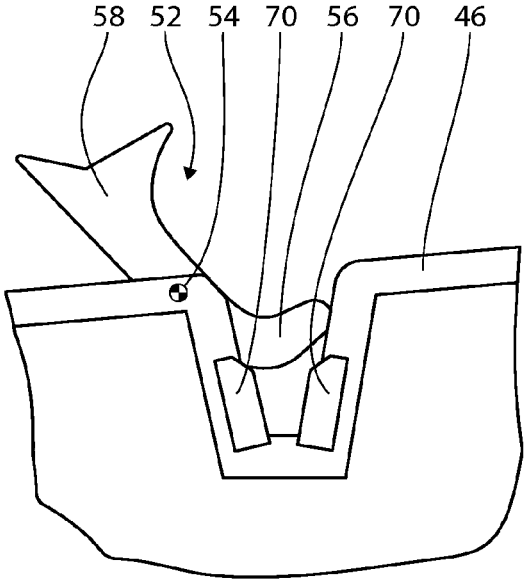
Figure 4B:
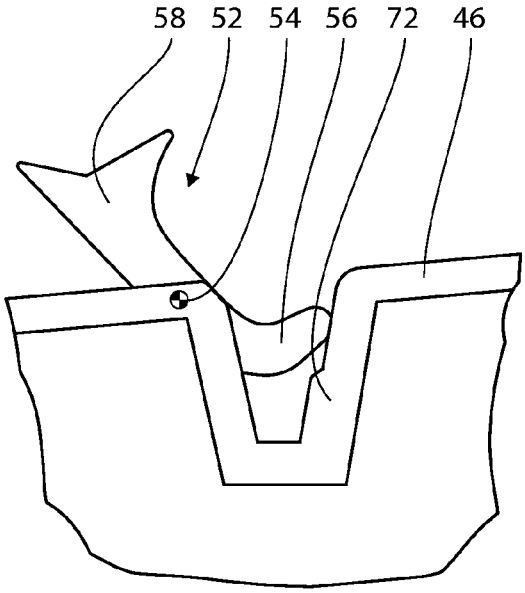

In FIGS. 4A and 4B, two variants of the generally V-shaped notches 48, 50 are shown. In FIG. 4A, the notch 50 is provided with two rubber elements 70 or similar elastically deformable elements serving to improve the arresting of the hose relative to the intentional position resting in the notches 48 and 50 of the rails or slides 44 and 46, respectively. The rubber elements 70 may be configured having a taper inwardly to or outwardly from the ship or vessel.

In FIG. 4B, an alternative of the notches is shown, in which a narrow lower end of the notch is provided serving to provide a controlled compression of the hose in its intentional position. In order to prevent that the connection between the oil supply rig 10 and the ship or vessel 30 shown in FIG. 1 may cause damage to the ship or vessel in case for instance a wave causes the ship or vessel to move and to prevent that the hose be torn or otherwise destroyed, the locking elements 52 may advantageously be provided with a hinge connection between the U-shaped lower part 56 and the L-shaped upper part 58 of the locking element as is illustrated in FIGS. 5A-5D in order to allow the one part, preferably the L-shaped upper parts 58 of the locking elements 52 relating to the U-shaped lower part 56 of the locking element 52.

Figure 5A:
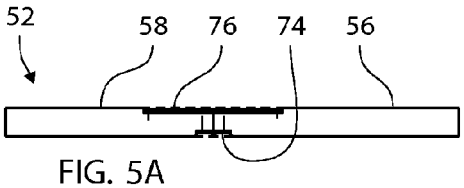
FIG. 5A-5D are schematic views of an element of the rail system according to the present invention shown in FIGS. 2A and 3A-3D, FIGS. 5E-5H are schematic views similar to the views of FIGS. 5A-5D of an alternative embodiment of the element of the rail system.
Figure 5B:
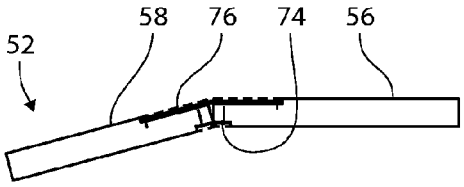
Figure 5C:
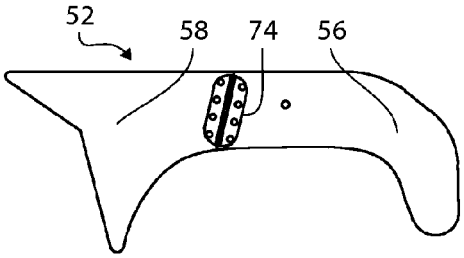
Figure 5D:
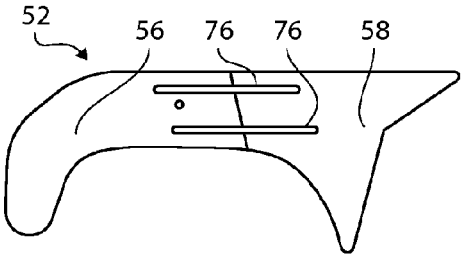
Figure 5E:
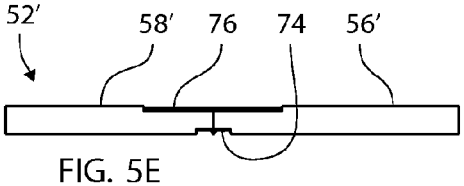
Figure 5F:
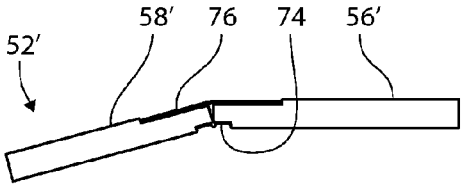
Figure 5G:
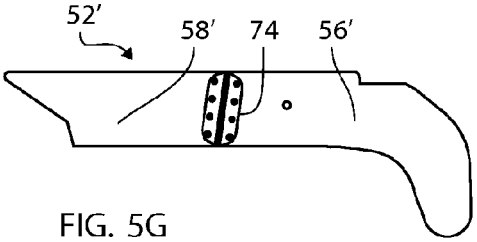
Figure 5H:
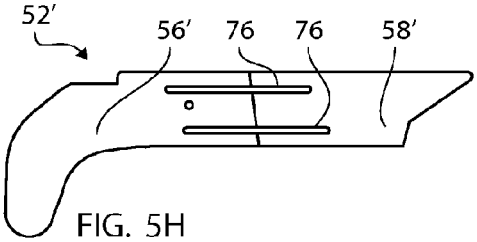

In FIGS. 5A and 5D, the locking element 52 is shown from above illustrating in FIG. 5A, a hinged connection 74 between the U-shaped lower part 56 and the L-shaped upper part 58 of the locking element and further a flexible return element 76. When an excessive pull is provided by the hose locked by the L-shaped upper part 58 of the locking element 52, the pull causes the L-shaped upper part 58 to swing or turn relative to the fixed U-shaped lower part 52 inwardly or outwardly relative to the ship or vessel as is illustrated in FIG. 5B allowing the hose to slide within the generally V-shaped notches 48 and 50 of the rails or slides 44 and 46, respectively, preventing the hose from being ruptured or causing injury to the ship or vessel 30.

In FIGS. 5C and 5D, the locking element 52 is shown in side elevational views illustrating in FIG. 5C the hinged connection 74 and in 5*d* the flexible return elements 76, which may be constituted by a spring element such as a bendable metal or rubber or polymer element.

A particular advantage of the above described presently preferred embodiment of the rail system according to the present invention relates to the overall structure of the system being implemented as a purely passive system which includes no actuators or hydraulically, pneumatically or electrically driven elements for operating the system in its 'self-running' positioning and arresting modes. Having said the above, certain elements, such as for instance the return elements 76, may in an alternative embodiment be constituted by hydraulic cylinders or similar operable elements allowing the two parts of the locking elements to be forcedly shifted relative to one another, e.g. in an emergency situation or simply in the step of disconnecting a single hose or all hoses interconnecting the oil supply rig or similar rig and the ship or vessel.

In FIGS. 5E-5H, an alternative embodiment of the locking element of the rail system according to the present invention is shown designated the reference numeral 52'. In the below description of the alternative embodiments, elements or components similar to previously described elements or components, respectively, serving the same purpose as the previously described elements or components, respectively, however differing in geometrical shape exclusively are designated the same reference numerals as the previously described component or element, however added the signature ' in order to identify the geometrical difference from the previously described component or element. Such slightly differently shaped or configured elements will only be described provided the different shape or configuration provide a different functionality as compared to the previously described element or component having the same integer reference as the element or component bearing the marking '.

The locking element 52' shown in FIGS. 5A-5H basically differs from the previously described locking element 52 in that the upper part 58' has a rectilinear surface to be contacted by the hose 28 whereas the upper part 58 of the previously described locking element 52 has a triangular extension serving to catch the hose.

As said above, the alternative embodiment of the locking element 52' basically serves the same purpose as the previously described locking element 52. The alternative embodiment of the locking element 52' is implemented in the modified rail system 40' shown in FIGS. 6A and 6B which differs from the above described first embodiment shown in FIGS. 2 and 3A-3D in that the rail system constitutes a rail system specifically intended for the application of modifying an existing ship, whereas the above described first and presently preferred embodiment shown in FIGS. 2 and 3A-3D is integrally included in the ship as the ship is built.

Figure 6A:
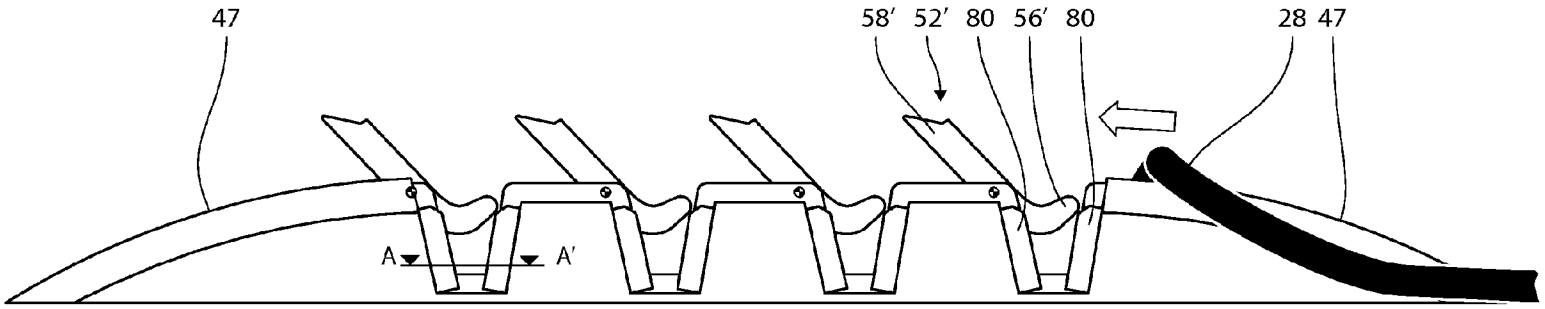
FIGS. 6A and 6B are schematic views similar to the views 3A and 3C of an alternative configurated rail system according to the present invention.
Figure 6B:
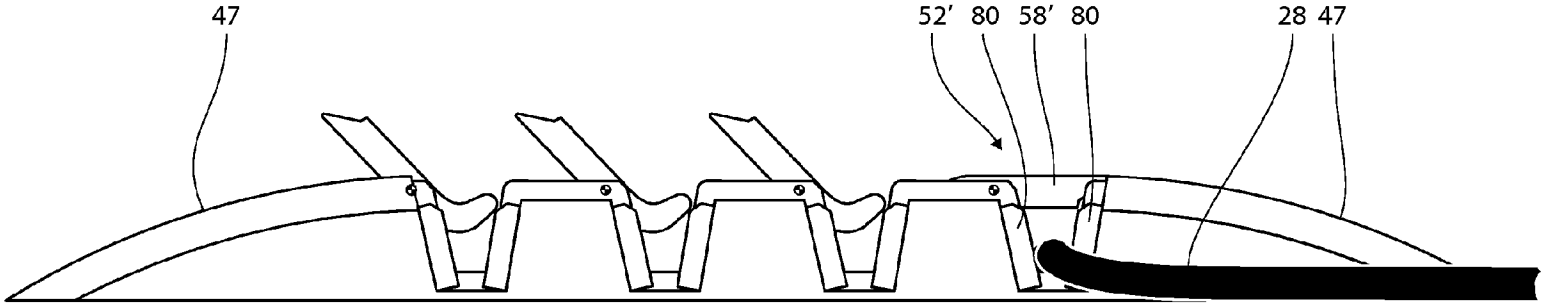

In FIG. 6A, the alternative embodiment of the rail system 40' is shown in which the V-shaped notches are supported relative to the hull of the ship by two curved rails 47 made from a tube. In FIG. 6A, the generally V-shaped notches of the second embodiment of the rail system 40' is shown in the initial step in which hose 28 is positioned on the right hand side curved rail 47 similar to the view of FIG. 3A whereas in FIG. 6B, the hose 28 is received in its intentional locked position in the alternative embodiment of the rail system 40' locked within the right hand side generally V-shaped notch by the upper part 58' of the locking element 52' resting on the hose. In FIGS. 6A and 6B, a further supplementary feature of the second or alternative embodiment of the rail system 40' is shown as sets of rubber plates and distance plates to be described in greater details with reference to FIGS. 7 and 7B are positioned at the slightly sloping vertical parts of the generally V-shaped notches. The assembly of distance plates and rubber plates is designated the reference numeral 80.

Figure 7A:
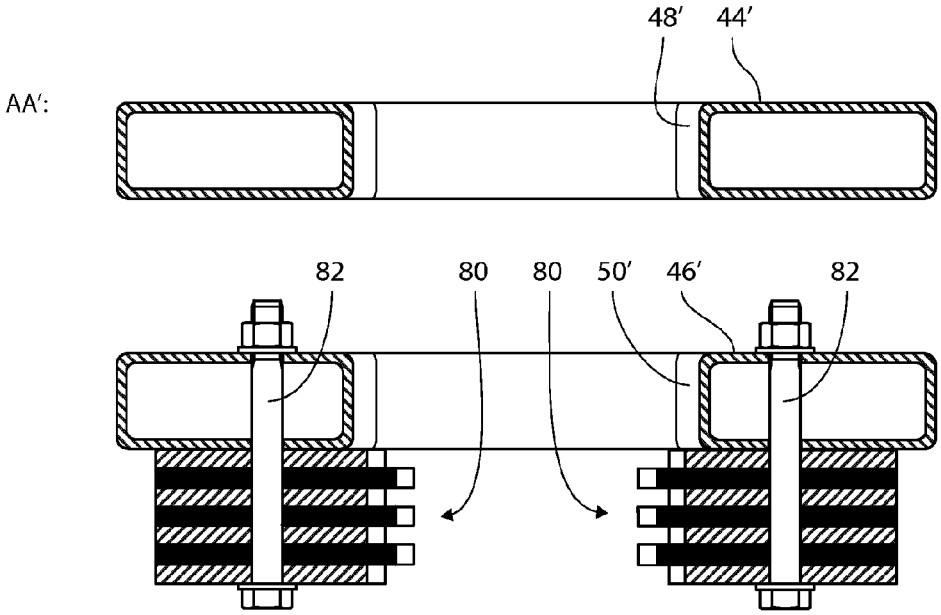
FIGS. 7A and 7B are details of the rail system shown in FIGS. 6A and 6B according to the present invention.
Figure 7B:
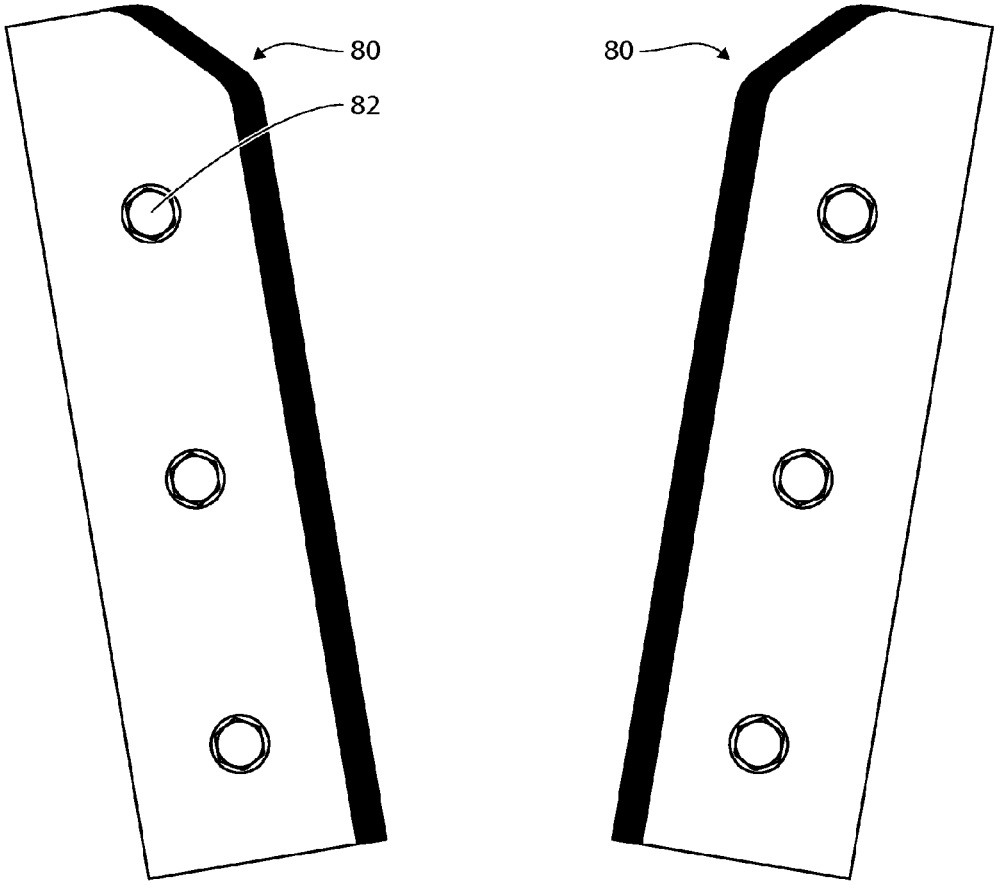

FIG. 7A is a horizontal sectional view along the line A-A' of FIG. 6A illustrating the opposite generally V-shaped notches 48' and 50' similar to the generally V-shaped notches 48 and 50 of the outer and inner rails 44 and 46, respectively, of the rail system 40 shown in FIG. 2.

By means of sets of bolts 82, the assemblies 80 are bolted to the inner rail 46' defining the inner V-shaped notch 50'. As is illustrated in FIG. 7A, the rubber plate and distance plate assemblies 80 are each composed of four metal distance plates between which a total of three rubber plates are sandwiched. As is evident from FIG. 7A, the rubber plates extend beyond the metal distance plates into the V-shaped opening of the generally V-shaped notch 50'.

In FIG. 7B, the two rubber plate and distance plate assemblies 80 are shown in an elevational vertical view illustrating the rubber plates extending inwardly beyond the metal distance plates.

Although the present invention has above been described with reference to a specific and presently preferred embodiment of the rail system and a ship or vessel including the rail system according to the present invention, the present invention is by no means limited to the above described embodiments, as a person having ordinary skill in the art will readily contemplate modifications and amendments of the above described elements of the rail system and the rail system itself and such obvious modifications or variants are to be considered part of the present invention as defined in the appending patent claims.

LIST OF PARTS

10. Oil supply rig
12. Leg
13. Lower floor
14. Upper floor
18. Landing platform
20. Container
22. Container
24. Container
26. Crane
28. Hose
30. Ship or vessel
32. Hull
34. Navigation bridge and engine room super structure
36. Tank or container
38. Inlet/Outlet
40. Rail system
40'. Modified rail system
42. Bulwark
44. Rail or slide
44'. Modified rail or slide
46. Rail or slide
46' Modified rail or slide
47. Curved rail
48. Generally V-shaped notch
48'. Modified generally V-shaped notch
50. Generally V-shaped notch
50'. Modified generally V-shaped notch
52. Locking element
52'. Modified locking element
54. Journaling shaft
56. U-shaped lower part
58. L-shaped upper part
58'. Alternative L-shaped upper part
60. Arrow
62. Arrow
64. Arrow
66. Arrow
68. Hose
70. Rubber element
72. Narrowing part
74. Hinge
74'. Alternative hinge
76. Flexible return element
76'. Alternative flexible return element
80. Rubber plate and distance plate assembly
82. Fixation bolt

The invention claimed is:

1. A rail system (40, 40') of a ship (30) for positioning and arresting a hose (28) for supplying fluid material to an oil rig (10) from the ship (30) or supplying fluid material to the ship (30) from the oil rig (10), said rail system (40, 40') comprising a rail (44, 44', 46, 46', 47) extending lengthwise at an upper edge of a bulwark of the ship (30), a vertical notch (48, 50) being provided in said rail (44, 44', 46, 46', 47) having a bottom width corresponding to the diameter of the hose (28), and a locking element (52, 52') of an elongated configuration being pivotally journaled adjacent to said vertical notch (48, 50) and being shiftable between a vertical position in which the hose (28) may be freely introduced into and positioned in said vertical notch (48, 50) and a horizontal position in which said locking element (52, 52') is blocking the entry into said notch (48, 50) and rests on the hose (28) for arresting the hose (28) in said notch (48, 50), and said locking element (52, 52') being journaled on a journaling shaft (54) relative to said rail (44, 44', 46, 46', 47) and defining in said vertical position a lower part (56) below said shaft and an upper part (58) above said shaft, said lower part (56) providing an extension extending in said vertical position of said locking element (52, 52') into said vertical notch (48, 50) for being contacted by said hose (28) for causing, by said hose (28) pressing onto said extension, said locking element (52, 52') to shift from said vertical position to said horizontal position.

2. The rail system (40, 40') according to claim 1, the system comprising a first plurality of vertical notches (48, 50) provided juxtaposed one another and an identical plurality of locking elements (52, 52') positioned adjacent a respective vertical notch (48, 50).

3. The rail system (40, 40') according to claim 1, said rail (44, 44', 46, 46', 47) being level with the upper edge of the bulwark of the ship (30).

4. The rail system (40, 40') according to claim 1, said upper part (58) of said locking element (52, 52') having a protrusion for contacting the outer surface of the hose (28) and defining in said horizontal position a top surface level or flush with said rail (44, 44', 46, 46', 47).

5. The rail system (40, 40') according to claim 1, said upper part (58) being hinged to said lower part (56) allowing said upper part (58) to swing relative to said lower part (56).

6. The rail system (40, 40') according to claim 5, said locking element (52, 52') further comprising a flexible return element configured for maintaining said locking element (52, 52') in said elongated configuration when not exposed to forces parallel with said journaling shaft (54).

7. The rail system (40, 40') according to claim 1, wherein said rail (44, 44', 46, 46', 47) slopes at an angle of between 5° and 15° relative to the upper edge of the bulwark of the ship (30).

8. The rail system (40, 40') according to claim 1, wherein said rail (44, 44', 46, 46', 47) defines a curve.

9. A method of positioning and arresting a hose (28) for supplying fluid material to an oil rig (10) from a ship (30) or supplying fluid material to the ship (30) from the oil rig (10), comprising providing a rail system (40, 40') comprising a rail (44, 44', 46, 46', 47) extending lengthwise at an upper edge of a bulwark of the ship (30), providing a vertical notch (48, 50) in said rail (44, 44', 46, 46', 47) having a bottom width corresponding to the diameter of said hose (28) and providing a locking element (52, 52') being of an elongated configuration and being pivotally journaled adjacent to said vertical notch (48, 50) and being shiftable between a vertical position and a horizontal position, the method comprising introducing said hose (28) into said notch (48, 50) while maintaining said locking element (52, 52') in said vertical position and shifting said locking element (52, 52') to said horizontal position and blocking the entry into said notch (48, 50) and arresting said hose (28) in said notch (48, 50).

10. A ship (30) or vessel for supplying fluid material to an oil rig (10) or for receiving fluid material from said oil rig (10), said ship (30) comprising a rail system (40, 40') including a rail (44, 44', 46, 46', 47) extending lengthwise at an upper edge of a bulwark of said ship (30), a vertical notch (48, 50) being provided in said rail (44, 44', 46, 46', 47) having a bottom width corresponding to the diameter of the hose (28), and a locking element (52, 52') of an elongated configuration being pivotally journaled adjacent to said vertical notch (48, 50) and being shiftable between a vertical position in which the hose (28) may be freely introduced into and positioned in said vertical notch (48, 50) and a horizontal position in which said locking element (52, 52') is blocking the entry into said notch (48, 50) and rests on the hose (28) for arresting the hose (28) in said notch (48, 50), and said locking element (52, 52') being journalled on a journaling shaft (54) relative to said rail (44, 44', 46, 46', 47) and defining in said vertical position a lower part (56) below said shaft and an upper part (58) above said shaft, said lower part (56) providing an extension extending in said vertical position of said locking element (52, 52') into said vertical notch (48, 50) for being contacted by said hose (28) for causing, by said hose (28) pressing onto said extension, said locking element (52, 52') to shift from said vertical position to said horizontal position.

11. The ship or vessel (30) according to claim 10, wherein the rail system (40, 40') further comprises a first plurality of vertical notches (48, 50) provided juxtaposed one another and an identical plurality of locking elements (52, 52') positioned adjacent a respective vertical notch (48, 50).

12. The ship or vessel (30) according to claim 10, wherein the rail (44, 44', 46, 46', 47) is level with the upper edge of the bulwark of the ship (30).

13. The ship or vessel (30) according to claim 10, wherein said upper part (58) of said locking element (52, 52') has a protrusion configured for contacting the outer surface of the hose (28) and defines in said horizontal position a top surface level or flush with said rail (44, 44', 46, 46', 47).

14. The ship or vessel (30) according to claim 10, wherein said upper part (58) is hinged to said lower part (56) so as to allow said upper part (58) to swing relative to said lower part (56).

15. The ship or vessel (30) according to claim 14, wherein said locking element (52, 52') further comprises a flexible return element configured for maintaining said locking element (52, 52') in said elongated configuration when not exposed to forces parallel with said journaling shaft (54).

16. The ship or vessel (30) according to claim 10, wherein said rail (44, 44', 46, 46', 47) slopes at an angle of between 5° and 15° relative to the upper edge of the bulwark of the ship (30).

17. The ship or vessel according to claim 10, wherein said rail (44, 44', 46, 46', 47) defines a curve.

* * * * *